United States Patent [19]

Palazzolo

[11] Patent Number: 4,728,408

[45] **Date of Patent: * Mar. 1, 1988**

[54] COMPACT ELECTROLYTIC SILVER RECOVERY SYSTEM

[75] Inventor: James C. Palazzolo, 1815 Lakewood Dr., Salt Lake City, Utah 84117

[73] Assignee: James C. Palazzolo, Salt Lake City, Utah

[ * ] Notice: The portion of the term of this patent subsequent to Dec. 31, 2002 has been disclaimed.

[21] Appl. No.: 813,690

[22] Filed: Dec. 27, 1985

Related U.S. Application Data

[63] Continuation-in-part of Ser. No. 619,634, Jun. 11, 1984, Pat. No. 4,561,957.

[51] Int. Cl.[4] ..... C25G 15/00

[52] U.S. Cl. ..... 204/229; 204/237; 204/275

[58] Field of Search ..... 204/229, 237, 109, 275; 417/40

[56] References Cited

U.S. PATENT DOCUMENTS

| | | | |
|---|---|---|---|
| 393,828 | 12/1888 | Hall | 417/40 |
| 3,090,849 | 5/1963 | Coulin | 417/40 |
| 3,450,622 | 6/1969 | Cothran | 204/109 |
| 3,524,805 | 8/1970 | Engleman | 204/109 |
| 3,715,291 | 2/1973 | Bentley | 204/109 |
| 3,926,768 | 12/1975 | Burgess | 204/109 |
| 3,959,110 | 5/1976 | Burgess | 204/109 |
| 4,305,805 | 12/1981 | Edgerton et al. | 204/222 |
| 4,345,879 | 8/1982 | Steiner | 417/40 |
| 4,561,957 | 12/1985 | Palazzolo | 204/229 |

FOREIGN PATENT DOCUMENTS

| | | | |
|---|---|---|---|
| 2067598 | 7/1981 | United Kingdom | 204/109 |

*Primary Examiner*—R. L. Andrews
*Attorney, Agent, or Firm*—Trask, Britt & Rossa

[57] ABSTRACT

An electrolytic silver recovery apparatus for the recovery of metallic silver from silver-laden solutions is disclosed. The apparatus has liquid level controls, interval electrical power controls, and a removable cathode. The apparatus is used particularly in conjunction with x-ray film developing systems to recover silver values from spent fixer solution in a manner whereby at least a substantial portion of the fixer solution may be returned to the film processor's replenishing tank for reuse.

6 Claims, 6 Drawing Figures

COMPACT ELECTROLYTIC SILVER RECOVERY SYSTEM

RELATED APPLICATION

This application is a continuation-in-part of U.S. patent application Ser. No. 619,634, filed June 11, 1984, entitled "Electrolytic Silver Recovery System," now U.S. Pat. No. 4,561,957.

BACKGROUND OF THE INVENTION

1. Field: This invention relates to electrolytic techniques and apparatus for recovering silver from silver-laden fixer solutions derived from photographic and x-ray film processors.

2. Prior Art: Various apparatus and techniques are utilized for the recovery of silver from silver-laden fixer solutions from photographic film processors.

Electrolytic techniques and apparatus employed in silver recovery systems are disclosed in U.S. Pat. Nos. 3,926,768 and 3,959,110 to Burgess; 3,715,291 to Bentley; 4,139,431 to Scheidegger, et al.; 4,166,781 to Staples; 4,362,608 and 4,287,044 to Biles, et al.; 3,964,990 to Woyden; 4,111,766 to Idota, et al.; and 4,127,465 and 4,078,983 to Higgins; and in United Kingdom Pat. No. 2,067,598.

The Higgens patents are representative of electrolytic silver recovery systems associated with photographic film processors wherein current is adjusted proportionately in relation to the rate of film processed. Systems employing techniques such as those employed by Higgins require extensive electronic sensing and control circuitry.

Other systems, such as those disclosed in the Burgess patents, employ a precollection chamber into which spent fixer solution is collected. Upon collection of a predetermined volume of solution, the spent (silver-laden) fixer solution is dispensed automatically into an electrolytic cell which is full of treated (desilvered) fixer solution. The cell, however, has only one discharge port, which is an overflow port. Silver-laden solution flowing into the upper portions of the cell will tend to make the upper portions of the solution in the container silver-rich. The overflow of this silver-rich solution in the upper regions of the container will tend to occur in disproportionate amounts in comparison with the original resident low-silver solution in the container. Thus, silver will be lost to the drain without being treated due to the container's structure and the manner of introducing silver-rich solution British Pat. No. 2,067,598 discloses a process and apparatus for recovering silver from photographic fixer solutions by electrolytic plating onto a cathode in which the plating current and a pump for withdrawing desilvered solution from the recovery tank are controlled by a timer and two liquid level switches where one switch is mounted above the other switch on the tank's side. One limitation of this apparatus involves the use of two switches, thus increasing costs and likelihood of malfunction. In order to agitate the solution, the cathode is attached to a motor by a gear train and is rotated. This attachment of the cathode to the motor makes the cathode's removal relatively difficult when the user wishes to recover the electroplated silver from the cathode. Also, in one mode, the British patent contemplates discharge of the fixer solution during desilvering, thus returning silver-bearing fixer solution to the film processing system's fixer tank. In an alternate mode, the British patent indicates operation wherein the pump is on only during discharge and is activated by a timer.

SUMMARY OF THE INVENTION

Figure 1:
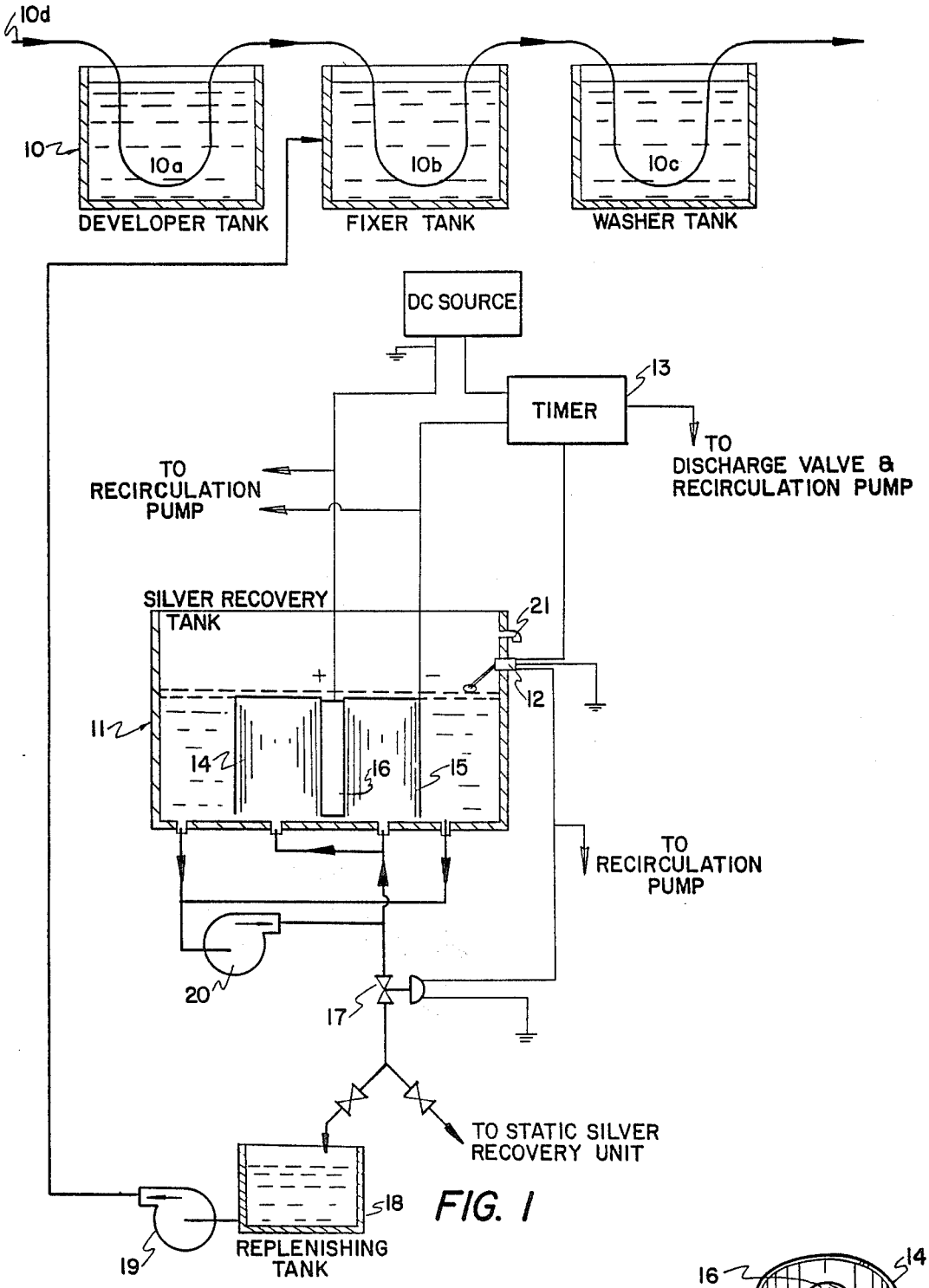
FIG. 1 is a schematic illustration of an electrolytic silver recovery unit (ESRU) featuring apparatus of the instant invention.

The instant invention relates to an electrolytic silver recovery technique and compact apparatus for effectively recovering silver from silver-laden photographic fixer solution in a manner such that the fixer solution is unharmed and 50% of the fixer can be returned automatically to the fixer replenishing tank for reuse.

The apparatus comprises a silver recovery tank (or other container) containing a significant volume of resident, treated (i.e., silver-depleted) fixer solution containing essentially no silver. An overflow line from a fixer tank in a film processor discharges directly into the silver recovery tank (SRT). Spent fixer solution containing from about 0.5 to over 1.0 ounce of silver per gallon (3.75 to over 7.50 grams per liter) periodically flows into the silver recovery tank. For example, each film processed in a typical x-ray film processor results in the addition of about 100 milliliters (ml.) of fresh fixer solution to the fixer tank of the film processor, causing an overflow of about 100 ml. of spent fixer solution from the fixer tank.

Typically, about 400 ml. to about 1000 ml. of spent fixer solution are collected, in addition to the resident treated solution, in the electrolytic silver recovery apparatus before a silver recovery cycle is commenced. The resident treated solution is usually about five to about fifteen times the volume of the spent fixer solution incrementally collected. Thus, an immediate dilution of silver concentration of the spent fixer solution occurs upon introduction of the spent fixer solution into the silver recovery tank. The silver recovery tank (SRT) has an overflow port which is usually located at a sufficient elevation above the upper level of solution in the tank after collection of spent fixer solution that inadvertent overflow of silver-rich solution does not occur.

The volume of spent fixer solution admitted to the tank before silver recovery begins is controlled by a liquid level switch or other means for determining the volume of the solution in the SRT. When the collected solution raises the total solution in the SRT to a certain level, a liquid level electrical switch, which preferably is a float-type switch, electrically activates a timer which initiates the electrolytic process whereby silver is removed from the solution in the SRT. The float-type switch can be fixed to the SRT wall with the float extending into the interior of the tank or it may be depended from a lid covering the SRT or from an overhead member supported by the upper edge of the SRT.

The timer is also connected to an electrode switch which controls electrical energy and energization of the cathode and anode. The timer is preset to control the flow of electrical energy to the anode and cathode for a predetermined time. A discharge valve-controlled drain means is connected to the SRT, either directly or through the recirculation pump, to drain desilvered solution from the tank. This drain valve is opened by the timer at the conclusion of the predetermined time period and closed by the switch being in its down position.

The timer is preferably a variable timer adjustable to control electrical flow for various time periods. A 328A Time Delay Relay by Automatic Timing and Controls Co. has been used with good results. Typically, a time period is chosen to correspond to the volume of silver-laden solution collected for treatment, the concentration of the silver in the silver-laden solution, and the magnitude of voltage applied to the electrodes. Although all of these factors can be varied, they are usually arbitrarily fixed by the operator so that day-in, day-out operation may be achieved without any required readjustment of the timer, switch or voltage.

Further description of the invention may be facilitated by reference to the attached drawings.

DESCRIPTION OF THE ILLUSTRATED EMBODIMENTS

FIG. 1 is a schematic view of an electrolytic silver recovery unit representing a preferred embodiment of the instant invention. The electrolytic silver recovery unit (ESRU) operates with a film processor 10 which consists of a developer tank 10*a*, fixer tank 10*b* and a wash tank 10*c*. Film, such as x-ray film 10*d*, is threaded through these tanks beginning with the developer tank, then moving to the fixer tank and finally through the wash tank in the standard photographic developing process. Silver material is removed from the film as it passes through the fixer tank. Some of the silver is physically carried with the film into the wash tank. Some of the developer is physically carried with the film into the fixer tank. Because of developer contamination, periodic dumping of the fixer tank is required. A useful feature of the instant invention is that the volume of the SRT is such that the entire fixer tank contents may be dumped into a drained SRT so that silver may be recovered by the ESRU.

The ESRU comprises a silver recovery tank (SRT) 11, a float switch 12 which is positioned generally more than midway up the wall of the tank, a timer 13 which controls certain functions of the ESRU, such as the time period during which voltage is applied between the cathode 14 and 15, and the anode 16. The timer also activates a solenoid-controlled discharge valve 17 which discharges a portion of the treated fixer solution into a replenishing tank 18 wherein at least a portion of the solution is then mixed with fresh solution contained within the replenishing tank and may be pumped by a pump 19 back to the fixer tank in the film processor. The discharge valve may also be manually activated.

The ESRU also includes a recirculation pump 20 which circulates the liquid in the SRT 11 during the period that voltage is applied to the cathode and anode. The pump 19 which returns the treated solution to the replenishing tank 18 may also function as the recirculation pump 20. The SRT 11 has also an overflow standpipe 21 which can go to a static silver recovery unit, e.g. of the iron filing type, before it is discharged to a drain. The overflow is located a substantial distance above the solenoid-controlled discharge valve 17 and above the level float switch 12. The overflow can either be a hole in the side of the tank or a pipe leading up from the bottom of the tank ending with an opening above the predetermined solution level.

Figure 2:
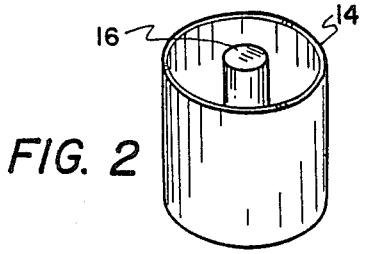
FIG. 2 is a perspective view of a cathode assembly useful in the electrolytic recovery unit of the present invention.

A particularly useful cathode assembly is illustrated in FIG. 2. Silver ions being positively charged migrate to the cathode wherein the silver ions join with an electron to form metallic silver which deposits on the cathode. The cathode is preferably constructed of a lightweight #316 stainless steel material which is a relatively effective current carrier. The cathode of this invention is a thin, flat, planar sheet folded to form a circular element of stainless steel.

The cathode and anode assembly comprises a pair of cylindrical stainless steel members made of thin #316 stainless steel sheet metal. The anode preferably is located concentrically within the cathode and is preferably about the same height as the cathode. The anode is about 4 to 8 inches (10.16 to 20.32 centimeters (cm.)) in height and preferably about 6 to 8 inches (15.24 to 20.32 cm.) tall. It is typically an open cylinder 2 to 4 inches (5.08 to 10.16 cm.) in diameter and preferably with a diameter of about 2 to 3 inches (5.08 to 7.62 cm.). The area of the anode thus may vary from about 24 to about 96 square inches (155 to 620 square cm.) and preferably from about 54 to about 72 square inches (348 to 465 square cm.). The anode and cathode areas may preferably be varied depending upon volume of solution to be treated and the concentration of silver therein. The anode areas set forth herein are for about 4 to 6 gallons (15.14 to 22.7 liters) of solution with a silver concentration of from about 0.125 to about 0.25 ounce per gallon (0.94 to 1.88 grams per liter) which is the concentration of the diluted solution formed by the mixing of the spent fixer with the residual solution in the SRT.

The cathode is about 6 to 8 inches (15.24 to 20.32 cm.) in diameter and preferably has a diameter of from about 6 to 7 inches (15.24 to 17.78 cm.). The height of the cathode is within about the same range as the anode. Generally, the height of the cathode is substantially equal to that of the anode. The area of the cathode ranges from about 72 to about 192 square inches (464.5 to 1239 square cm.) and preferably is from about 100 to about 170 square inches (645 to 1097 square cm.).

The current density at the cathode varies from less than about 0.05 amp. per square inch to about 0.1 amp. per square inch (0.00775 amp. per square cm. to about 0.155 amp. per square cm.). The current density at the anode ranges from less than about 0.1 amp per square inch to about 0.3 amp per square inch (0.0155 amp. per square cm. to about 0.0465 amp. per square cm.). The total amperage is preferably about seven amps.

The circulation system for the SRT is structured such that solution is drawn from outside the cathode and then introduced into the annulus-shaped lumen between the anode and cathode to introduce continuously new solution into the electrolytic zone. The rate of circulation should be sufficiently vigorous that the solution between the anode and cathode is not permitted to "burn." For a tank having a capacity of 4 to 6 gallons (15.14 to 22.7 liters), a circulation rate of about 4 to 8 gallons per minute (15.14 to 30.25 liters per minute) is quite satisfactory if a pump is used. A Little Giant Pump®, Model 4-MD-SC has been used with good results. Those skilled in the art will recognize that any suitably sized and powered pumping mechanism will work.

The level of solution in the SRT is preferably maintained above the top edges of the anode and cathode, especially when current is passing between the anode and cathode. Operation of the SRT under electrolytic recovery techniques with the anode and/or cathode above the solution level tends to cause frothing. To avoid all possibility of frothing, it is preferable to maintain the solution level above the top of the cathode and anode even when the current is not being applied to these electrodes. The proper solution level can be determined by selecting electrodes of the proper height with respect to location of the liquid level switch (float switch). The location of the liquid level switch is determined by the level of the overflow discharge and the ratio of solution to be admitted for treatment to the amount of resident (treated) solution present.

Figure 3:
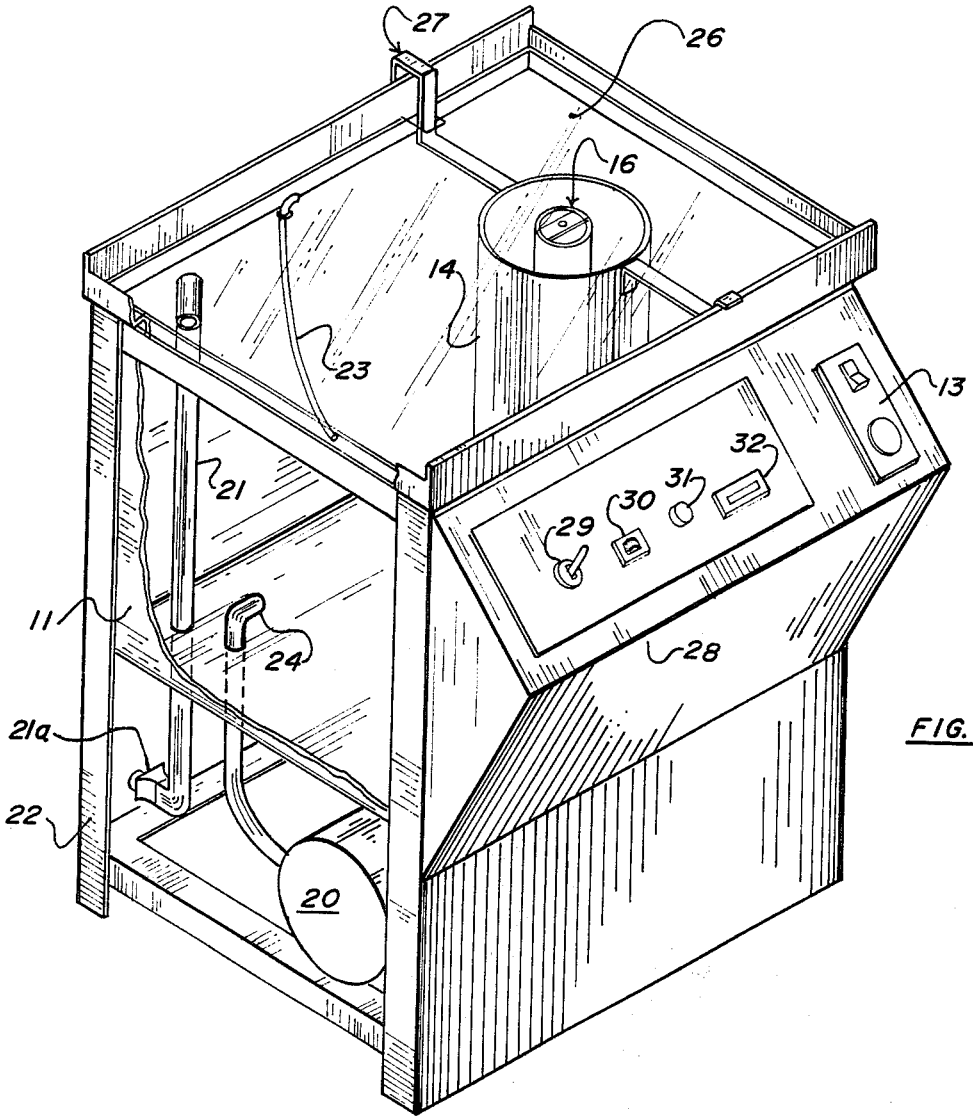
FIG. 3 is an elevational perspective view of a preferred compact embodiment of the instant invention.

FIG. 3 is an elevational perspective view of a preferred compact embodiment of the ESRU. It depicts the SRT 11, the timer 13, the removable, cylindrical, open-ended cathode 14 and 15, the smaller cylindrical, tubular anode 16 mounted concentrically within the cathode, the recirculation pump 20, the overflow standpipe 21 draining through a valve **21*a* to a static recovery unit, the frame 22, the feed tube 23 from the fixer tank 10*b*, and the intake fixture 24 for the recirculation pump 20**.

This particular embodiment of the ESRU has several advantages. The SRT's dimensions are approximately 15 inches (38.1 cm.) by about 10 inches (25.4 cm.) by about 10 inches (25.4 cm.), having a total volume of approximately 6 gallons (22.7 liters), of which 5 gallons (18.9 liters) of the available volume are used. The SRT 11 therefore contains sufficient treated fixer solution to dilute the incoming fixer solution should the ESRU's electroplating process malfunction before returning the fixer solution to the film process replenishing tank 18. The dimensions are small enough, however, that the SRT 11 (and therefore the ESRU) does not take up much physical space in a typically small film processing room.

The SRT 11 has a lip running along the upper edges of its walls. This lip supports the SRT 11 on a hexahedryl metal frame 22. This hexahedryl metal frame 22 has dimensions of slightly greater than 15 inches (38.1 centimeters) in width by about 18 inches (45.7 centimeters) in height by about 10 inches (25.4 centimeters) in depth. The frame's dimensions support the SRT about 8 inches (20.3 centimeters) above the surface area on which the ESRU is sitting. This allows sufficient space for the recirculation pump 20, solenoid-controlled discharge valve 17, and necessary tubing to be contained within the space occupied by the hexahedryl frame, underneath the SRT.

A transparent, removable panel with dimensions of about 15 inches (38.1 cm.) by about 10 inches (25.4 cm.) sits atop the SRT 11. This lid prevents foreign objects from dropping into the SRT 11, while allowing the operator to look inside to determine if the recirculation pump 20 or the entire ESRU is working properly.

If desired, an electrical interlock switch may be associated with said lid so that the unit will not function unless the lid is in position on the tank. Such a feature precludes operation of the unit with the electrodes exposed. Thus, the electrodes could not be inadvertently shorted by a foreign object or cause a shock to an operator, albiet a mild shock, because of the low voltages involved.

Also, a lock may be associated with the lid so that the removable cathode, especially a silver-laden cathode, could not be removed without authorization.

The feed tube 23 from the fixer tank **10*b* enters the SRT 11 from the top panel 26, instead of from the bottom or sides, of the SRT 11. This mounting enables the operator to easily disconnect the ESRU from the fixer tank 10*b* to facilitate moving the ESRU for cleaning or other reasons. The operator need only lift off the lid and disconnect the electric cord and tubing connecting the ESRU to the replenishing tank 18** and the ESRU is transportable.

Only one hole is present in the SRT's sidewalls, and this hole is for the liquid level switch 12. This switch is mounted onto the wall of the SRT adjacent the instrument panel rather than the sides or back of the SRT 11. Such mounting prevents accidental breakage to the switch by the ESRU operator or other person who might accidentally bump into any external, outwardly extending portion of the switch 12.

Three holes are present in the bottom of the SRT 11. The first is used as a mount and aperture for an overflow standpipe 21. The second is a mount and aperture for the recirculation pump's inlet fixture 24. The last is for the recirculation pump's outlet fixture 25. Mounting on the SRT's bottom rather than the sides again prevents accidental breakage by someone bumping into the ESRU. This mounting also retains the ESRU's compactness and still allows the operator sufficient access to maintain and repair the ESRU.

The recirculation pump's outlet fixture 25 is a two-pronged fitting made of pipe. It is sized and shaped to fit within the annulus between the anode 16 and cathode 14 and 15 so as to provide circulation of fixer solution for electroplating onto the cathode 16. Without recirculation, the ESRU would need to rely merely on the silver cation's migration to the cathode 14 and 15.

Also, without circulation, the solution between the cathode and anode would be depleted of silver while the solution in the remainder of the tank would remain silver-rich. Proper circulation maintains the silver concentration in the tank substantially uniform.

This preferred embodiment also has only one pump 20 which recirculates the fixer solution during treatment and also returns the desilvered fixer solution to the replenishing tank 18. Such a dual purpose is accomplished by placing a solenoidcontrolled discharge valve 17 behind the pump 20. If the discharge valve 17 is open, the pump returns solution to the replenishing tank 18 as to an intermediate fixer solution replenishing tank until the SRT's solution volume decreases enough to deactivate the liquid level switch which closes the discharge valve 17. If the discharge valve 17 is closed, the pump recirculates the fixer solution being treated through the SRT 11 for electroplating onto the cathode 14 and 15.

The cathode 14 and 15 has arms 27 attached to it which position the cathode properly in the SRT 11 and provide a handle for easy removal of the cathode from the SRT by the operator. Since the SRT 11 is usually made of an electrically nonconductive, corrosion-resistant plastic mateial, e.g. polyethylene, polypropylene, and the like, arms 27 may be electrically conductive although non-conductive arms may be preferred to avoid possible electrical shorts. The cathode is cylindrically shaped, approximately 6 to 7 inches (15.2 to 17.8 cm.) in diameter and 6 to 8 inches (15.2 to 20.3 cm.) in length so as to fit within the SRT 11. The cathode therefore has a surface area in contact with the fixer solution of approximately 113 square inches to about 175 square inches (730 square cm. to about 1135 square cm.).

It is generally preferred that the height of the cathode is less than the height of solution during operation, otherwise some foaming may occur at an air-solution-cathode interface. Also, it is generally preferred that the cathode, especially if it is a continuous solid cylindrical element, not sit on the bottom of the tank, it being desirable to permit the liquid solution to circulate both above and below the cathode. In an altèrnative mode, the cathode can have a uniform serated edge which allows the cathode to sit on the SRT's bottom while maintaining circulation above and below the cathode.

The anode 16 is also cylindrically shaped and is attached to the top panel 26 so as to be concentric with the cathode when the top panel 26 is properly positioned on the SRT 11. It too is from 6 to 8 inches (15 to 20.3 cm.) long, but has a diameter of only about 2 to 4 inches (5.1 to 10.2 cm.). The anode's cylindrical shape cooperates electrolytically with the cathode 14 and 15.

This preferred embodiment's operation and instrumentation panel 28 is angled, but any other protruding enclosure would be just as useful. It is also sturdily mounted to the hexahedryl frame 22 of the ESRU. The panel 28 includes an on/off or key switch 29, a voltage regulator 30, a fuse and holder 31, an amperage meter 32, and the controls for the timer unit 13.

Since the resistance to current is substantially constant within the fixer solution, the voltage regulator 30 effectively regulates the amperage of the current through the solution. The voltage regulator 30 allows the operator to run fixer solution which is to be discarded, i.e. not returned to the replenishing tank, through the ESRU quickly by increasing the voltage (and therefore the amperage) through the solution and decreasing the amount of time on the timer unit 13. However, this process may result in a lower grade of silver deposited on the cathode 14 and 15, especially if the silver in solution is depleted before the electroplating cycle ends.

The amp meter 32 shows the operator the amount of current passing through the fixer solution to indicate that everything is in control. This capability to increase voltage and amperage of the ESRU saves the operator time in processing batches of fixer solution which are too degraded by the presence of contaminants, such as developing solutions, to be further recycled for further use as fixer solution. Thus, if the only objective of treating a solution is to recover silver without concern over "burning" of the solution, then the voltage and amperage may be high to rapidly deposit the silver from the solution which can still be timed for proper silver consistency.

The presence of the fuse and holder 31 on the instrumentation and control panel 28 enables the operator to change the fuse easily and rapidly.

Figure 4:
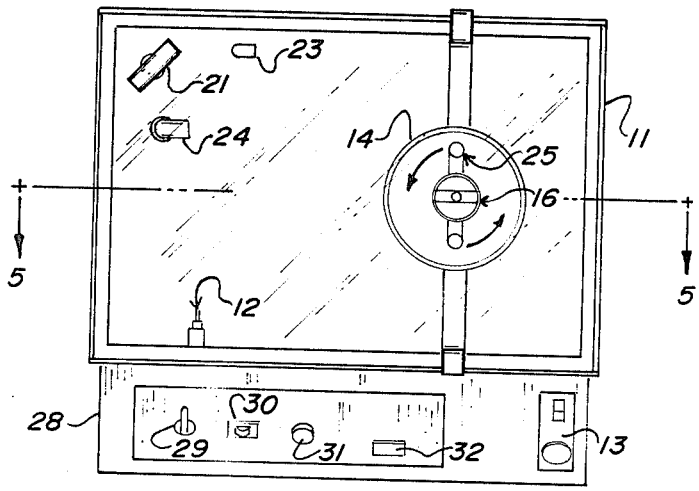
FIG. 4 is a top plan view of the embodiment illustrated in FIG. 3.

FIG. 4 is a top plan view of the same preferred compact embodiment of the ESRU (see FIG. 3), depicting the tank 11, the float switch 12 mounted to one wall of the tank 11, the timer unit 13, the removable cylindrical tube cathode 14 and 15, the concentrically mounted cylindrical tube anode 16, the overflow standpipe 21, the feed tube 23 from the fixer tank **10*b*, the recirculation pump inlet fixture 24, the outlet fixture 25, the operation and instrumentation panel 28, the on/off or key switch 29, the voltage regulator 30, the fuse and holder 31, and the amperage meter 32**.

Figure 5:
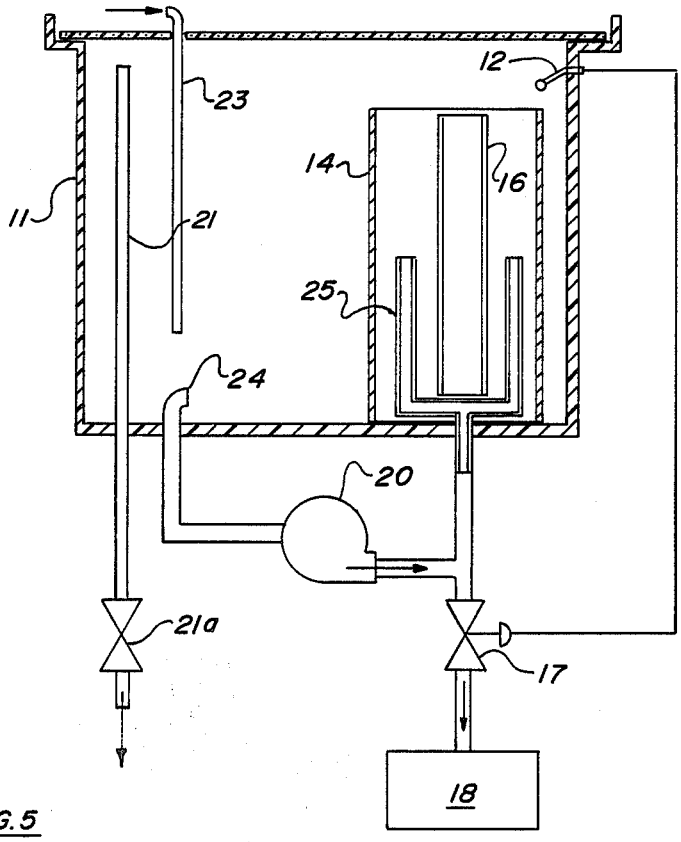
FIG. 5 is a cross-sectional side view of the preferred compact embodiment of the invention along section lines 5—5 of FIG. 4 with certain components of the invention, such as the pump and certain valves, being represented schematically.

FIG. 5 is a cross-sectional side view of a preferred compact embodiment of the ESRU, utilizing schematic symbols to represent the ESRU's pump and valves. This figure of the ESRU includes the tank 11, the float switch 12, the removable, cylindrical tube cathode 14 and 15, the concentrically mounted, smaller cylindrical tube anode 16, the solenoid-controlled discharge valve 17, the replenishing tank 18, the recirculation pump 20, the overflow standpipe 21 draining through a valve **21*a* to a static recovery unit, the feed tube 23 from the overflow of the fixer tank 10*b*, the inlet fixture 24 for the recirculation pump 20, and the tong-shaped recirculation pump outlet fixture 25**.

Figure 6:
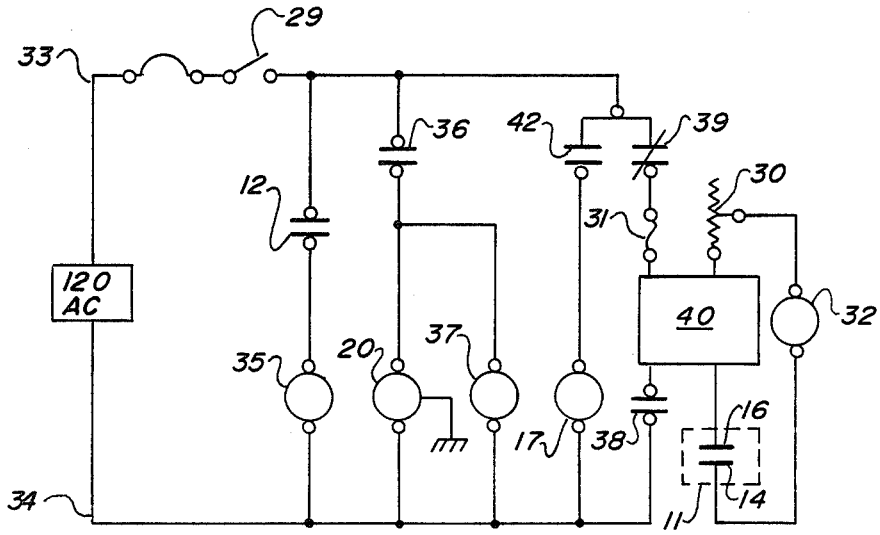
FIG. 6 is an electrical schematic representation of the invention.

FIG. 6 is an electrical schematic representation of the invention shown with the toggle switch 29 open. A 120 volt alternating current power source 33 and 34 is connected by a circuit breaker to an open on/off toggle switch 29 capable of handling 10 amps. An Arrow Hart No. 82600 toggle switch has produced satisfactory results. When the on/off switch 29 is closed, current travels to the float switch 12 potentiating the float switch 12. When the fixer solution level in the SRT 11 attains a specific height due to the fixer solution coming in from the processor, fixer tank **10*b*, it closes the float switch 12. When the float switch 12 is closed, current flows to the general purpose relay 35, which in turn closes relay contacts 36 and 38**.

Upon the closing of relay contact 36, current reaches the recirculation pump 20, causing the fixer solution within the ESRU to recirculate. Also, upon the closing of relay contact 36, a predetermined time delay relay 37 is activated.

Upon the closing of relay contact 38, the circuit is completed allowing current to pass through closed contact 39. current passes through closed contact 39 and through an in-line fuse 31 to a power supply unit 40. The power supply unit converts the alternating current into direct current and directs the current through a one ohm, one hundred watt, adjustable resistor 30. The current is measured by amp meter 32. The direct current passes to the cathode 14 and 15, through the fixer solution being treated in the SRT 11, to the anode 16, and back to the power supply unit 40. The polarized energizing of the electrodes causes silver to plate out from the fixer solution onto the cathode.

After a predetermined time interval, the time delay relay 37 opens contact 39 and closes contact 42. Opening contact 39 depolarizes the electrodes 14 and 15 and 16, stopping the electroplating process. Closing contact 42 activates the solenoid-controlled discharge valve 17, causing the recirculation pump 20 to stop recirculating the solution and to start returning fixer solution from the SRT 11 to the replenishing tank 18 or to an intermediate holding tank or drain. The resultant lowered solution level in the SRT 11 causes the float switch 12 to go to its "off" or open position, deactivating the recirculation pump 20 through opening the general purpose relay 35, which opens relay contact 36, deactivating the recirculation pump 20. Deactivating relay contact 36 also deactivates the time delay relay 37, causing contact 42 to open, thereby closing the solenoid-controlled discharge valve 17. The deactivation of the time delay relay 37 also causes contact 39 to close, returning the ESRU to its resting state.

In the instant invention, the sequence of operations begins with the overflow of silver-laden fixer solution (spent fixer solution) from the fixer tank's overflow well of the film processor to the ESRU. The used fixer solution contains typically about 0.5 to about 1.0 ounce of silver per gallon (3.75 to 7.5 grams per liter). At the time the used fixer solution flows into the ESRU, the ESRU contains a significant volume of treated fixer solution, that is, fixer solution which has been electrolytically treated to reduce the silver level thereof. The concentration of silver in the resident treated fixer solution in the ESRU generally approaches zero.

At the time used fixer solution flows into the ESRU, the solenoid-controlled discharge valve 17 from the ESRU is in a closed position and the float switch 12 is in a down position. Used fixer solution continues to flow periodically into the ESRU until the float switch is raised to a sufficiently high level to activate the switch in its uppermost position. The activation of the float switch in its "up" position then activates the timer unit 13. The timer unit closes a switch internal in the timer unit to the cathode-anode circuit to initiate electrolytic recovery of the silver in the ESRU. The timer also activates the recirculation pump to initiate recirculation of solution within the ESRU.

The current applied to the cathode and anode is generally less than about 8 amps. The period of time during which the current is on may depend upon the exact volume of the ESRU and the volume of spent fixer solution represented by differences in level between the discharge opening of the ESRU and the upper level of the float switch. Typically, this volume of spent fixer is from about 1 gallon per hour to about 2 gallons per hour (3.785 liters per hour to about 7.57 liters per hour) and the time duration during which current is applied is usually from about one hour to about two hours. Usually, the volume of resident treated fixer solution is from about three to about four gallons (1.36 to about 15.14 liters). At the low level of current employed, the fixer solution being treated is not burned.

Many electrolytic units use high amperage current which can result in "burning" (sulfiding) of the fixer solution unless very precise controls are employed. Burned fixer solution contains chemicals which are broken down (decomposed) and the residue products are contaminants which tend to contaminate the fixer solution if it is returned to the fixer tank in a film processor. Burned fixer solution can result in spots, shadows, and the like on film processed through burned fixer solution. Operation of the ESRU of the instant invention at current levels of less than about 8 amps avoids burning of the fixer solution. Generally, electrolytic units have no provision for shutting themselves down after the solution is depleted of silver, resulting in "over-plating" (i.e., the solution is subject to constant electrolysis).

At the end of a predetermined time period, the timer turns off the current to the anode and cathode and opens the solenoid-controlled discharge valve. Up to 50% of the silver-depleted solution flows to a replenisher tank from which it can be reintroduced to the fixer tank in the film processor, the rest of which is disposed of into a drain. As the solution in the ESRU tank drops to the level of the discharge valve, the float switch 12 activates in its "down" position to turn off the discharge valve 17. The ESRU has then completed one cycle and is in a condition to receive periodic overflow of used fixer solution from a fixer tank of a film processor.

In a film processor, usually about 100 ml. of fresh fixer solution is introduced into the fixer tank for each x-ray film processed. The solution in the fixer tank usually contains at least about 0.5 ounce of silver per gallon (37.5 grams per liter). Thus, in an ESRU which has a permanent resident volume of treated fixer solution which is at least equal to about five times up to about twenty times the volume of used fixer solution introduced into the ESRU for treatment during any one cycle, the concentration of silver in the ESRU at the start of the treatment cycle is generally at least 0.02 ounce of silver per gallon 0.15 gram per liter). If a fixer tank of a film processor is operated at a higher concentration of silver, then a higher concentration of silver will exist in the ESRU at the beginning of the treatment cycle.

It is to be understood that the resident volume of treated solution may be varied in the construction of the ESRU, for example, the permanent resident volume may be as low as 2:1 in comparison to the volume of used fixer solution treated during any one cycle. Typically, an ESRU contains about 0.025 to about 0.125 ounce of silver per gallon (0.188 to about 0.938 gram per liter) at the beginning of any treatment cycle. The method of operation of a particular film processor can be determined and the amount of time to be set for a treatment cycle can be determined from that. The time period for a treatment cycle is generally sufficient to reduce the silver concentration in the treated solution in the ESRU to about zero ounces of silver per gallon (zero grams per liter).

An advantage of the instant invention is that there is direct communication between the overflow of the fixer tank and the ESRU recovery tank. Thus, while the current is flowing to the cathode and anode, the film processor may be operated and used fixer solution may be discharged to the ESRU. Thus, while at the start of the cycle a predetermined volume is being treated, the operation of the ESRU is at very low amperage, about 2½ to about 7 amps, to prevent burning of the fixer solution and it is also operated with a relatively large resident volume of treated solution. Thus, if a few hundred milliliters of used fixer solution come into the tank even late in the treatment cycle and the silver contained therein is not recovered during that particular treatment cycle, the silver concentration is diluted to such a very low volume that the solution may be readily returned to the fixer replenishment tank.

For example, in an ESRU having a volume of several gallons (approximately 19 liters) and a concentration of silver at approximately zero, the introduction of a couple hundred milliliters of fixer solution containing 0.5 ounce per gallon (3.752 grams per liter) of additional silver would introduce only about 0.025 ounce (0.710 gram) of silver into the ESRU whereby the silver concentration in an ESRU having a minimum volume of 2 gallons (7.6 liters) would result in a silver concentration of 0.0125 ounce of silver per gallon (0.094 gram per liter). Treated fixer solution having such low silver concentrations may be readily returned to a fixer tank in a film processor. Such a feature is useful should the ESRU malfunction and no one discover the malfunction until later.

A timer useful in the instant invention for controlling the application of electrical power to the electrodes is one available from Automatic Timing & Controls Company, identified as ATC 328A. This particular timer is an NOS-integrated circuit timer having a dial-adjustable time delay relay with six selectable ranges which provide time delays from 0.05 second to 10 hours. Depending upon how it is wired into a system, the timer will operate in an on-delay, off-delay or interval mode of timing.

In the instant invention, the timer is typically wired to provide interval timing. In this mode, the relay pulls in at the start of the timing period and drops out at the end of the timing period. The relay is thus energized for the entire timing interval. At the conclusion of the time interval, the timer returns to a before-start condition, ready to be activated for the next timing interval.

The unit as described and shown in FIG. 3 is also very compact, taking up less than 3.5 cubic feet (0.099 cubic meter). As such, it can be stored and used at or near the photoprocessing laboratory without getting in the way of the workers.

Those skilled in the art will recognize that the embodiments hereinbefore discussed are illustrative of the general principles of the invention. The embodiments herein described are not intended to limit the scope of what applicant regards as his invention as hereinafter set forth.

I claim:

1. An electrolytic silver recovery unit for recovering silver from film fixer solutions comprising:

container means for holding film processing system fixer solution from which silver is to be removed;

at least one removable cathode assembly sized to fit within the container means;

at least one anode assembly sized and shaped to cooperate electrolytically with the cathode assembly;

circulation means for circulating the fixer solution around the cathode and anode assemblies;

switch means for both activating the circulation means and a timer unit when the switch means is in an on position and later deactivating the circulation means and a discharge valve when the switch means is in an off position, the switch means being activated to an on position by the fixer solution's attainment of a predetermined greater amount in the container means and being deactivated to an off position by a decrease in the fixer solution's volume to a predetermined lesser amount in the container means;

a timer unit connected to and activated by the switch means, the timer unit also connected to an electrode switch which controls electrical energization of the cathode and anode assemblies, the timer unit preset to control flow of electrical energy to the anode and cathode assemblies for a predetermined time period, the timer also activating a discharge control valve; and discharge valve-controlled drain means for draining desilvered fixer solution from the container means, the discharge valve-controlled drain means being opened by the timer unit at the conclusion of the predetermined time period and being closed by the switch means being deactivated to an off position.

2. The electrolytic silver recovery unit of claim 1 wherein the cathode and the anode are concentrically-mounted open cylindrical tubes.

3. The electrolytic silver recovery unit of claim 1 wherein the circulation means is a pump.

4. The electrolytic silver recovery unit of claim 1 wherein the switch means is a liquid level switch mounted to one side of the container means.

5. The electrolytic silver recovery unit of claim 1 wherein the switch means is depended from a top panel covering the container means.

6. A compact electrolytic silver recovery unit for recovering silver from film fixer solutions and for returning desilvered fixer solution to a film processing system comprising:

a hexahedral frame that stably supports itself on a horizontal surface area;

a tank for holding fixer solution from a film processing system from which silver is to be removed, comprising:

front and back walls having dimensions of about 38.1 centimeters by about 25.4 centimeters, a pair of side walls having dimensions of about 25.4 centimeters by about 25.4 centimeters, and a bottom panel having dimensions of about 38.1 centimeters by about 25.4 centimeters, wherein the front, side and rear walls each lie in a vertical plane, with the bottom panel lying in a horizontal plane, wherein the front and rear walls have their bottom edges connected to the front and rear edges, respectively, of the bottom panel, with the side walls having their bottom edges connected, respectively, to the side edges of the bottom panel, and wherein the tank is recessably mounted within the hexahedral frame by a lip which extends outwardly along the top edges of the front side, and rear walls of the tank which abuts against the hexhedral frame so that the frame elevates the tank to about 27.94 centimeters about the horizontal surface area;

a transparent removable top panel having dimensions approximating those of the bottom panel, slidably connected to the top of the tank so as to cover the tank;

a removable cylindrical cathode having a diameter of about 15.24 centimeters to about 17.78 centimeters and a length of about 15.24 centimeters to about 20.32 centimeters;

a cylindrical anode having a diameter of about 5.08 centimeters to about 10.16 centimeters and a length of about 15.24 centimeters to about 20.32 centimeters mounted to the top panel, wherein the anode and cathod are placed concentrically within the tank;

pump means mounted to the frame underneath the tank and within the frame's sides for recirculating the solution within the tank and for returning desilvered fixer solution to the film processing system;

a liquid-level switch fixed to an inner wall of the tank which is activated to an on position by attainment of a predetermined upper solution level within the tank and deactivated to an off position by attainment of a predetermined lower solution level within the tank, the switch activating the pump to recirculate solution within the tank and to activate a timer unit when the switch is activated to an on position and deactivating the pump and a discharge valve when the switch is deactivated to an off position;

a timer unit connected to and activated by the liquid level switch, the time also connected to an electrode switch which controls electrical energization of the cathode and anode, the time preset to control flow of electrical energy to the anode and cathode for a predetermined time period, the timer activating a discharge control valve; and discharge valve-controlled drain means to drain desilvered solution from the tank, the drain valve being opened by the time at the conclusion of the predetermined time period and closed by the liquid level switch being deactivated to the off position.

* * * * *